US005193811A

United States Patent [19]

Okumoto et al.

[11] Patent Number: 5,193,811

[45] Date of Patent: Mar. 16, 1993

[54] WOOD TYPE GOLF CLUB HEAD

[75] Inventors: Takaharu Okumoto, Chigasaki; Atsushi Onozato, Hiratsuka, both of Japan

[73] Assignee: The Yokohama Rubber Co., Ltd., Tokyo, Japan

[21] Appl. No.: 786,747

[22] Filed: Nov. 1, 1991

[30] Foreign Application Priority Data

Nov. 9, 1990 [JP] Japan ..... 2-117200[U]
Nov. 9, 1990 [JP] Japan ..... 2-117201[U]
Nov. 9, 1990 [JP] Japan ..... 2-117202[U]

[51] Int. Cl.[5] ..... A63B 53/04

[52] U.S. Cl. ..... 273/167 F; 273/167 H; 273/172; 273/173

[58] Field of Search ..... 273/167-175, 273/77 R, 77 A

[56] References Cited

U.S. PATENT DOCUMENTS

| | | | |
|---|---|---|---|
| 1,213,382 | 1/1917 | Kent | 273/174 X |
| 1,525,352 | 2/1925 | Aitken | 273/173 |
| 1,526,438 | 2/1925 | Scott | 273/174 X |
| 1,538,312 | 5/1925 | Beat | 273/171 |
| 1,538,415 | 5/1925 | Tootle et al. | 273/172 |
| 1,549,993 | 8/1925 | Klin | 273/172 |
| 1,575,364 | 3/1926 | Hodgkins | 273/171 X |
| 2,332,342 | 10/1943 | Reach | 273/171 |
| 3,692,306 | 9/1972 | Glover | 273/172 X |
| 4,162,794 | 7/1979 | Thompson | 273/174 |
| 4,728,105 | 3/1988 | Kobayashi | 273/173 X |
| 4,867,458 | 9/1989 | Sumikawa et al. | 273/171 |
| 4,874,171 | 10/1989 | Ezaki et al. | 273/174 X |
| 5,058,895 | 10/1991 | Igarashi | 273/171 X |

FOREIGN PATENT DOCUMENTS

| | | | |
|---|---|---|---|
| 3005767 | 1/1988 | Japan | 273/167 R |
| 2991 | of 1907 | United Kingdom | 273/169 |
| 376903 | 7/1932 | United Kingdom | 273/167 R |

*Primary Examiner*—V. Millin
*Assistant Examiner*—Sebastiano Passaniti
*Attorney, Agent, or Firm*—Finnegan, Henderson, Farabow, Garrett & Dunner

[57] ABSTRACT

A wood type golf club head comprising a head body consisting mainly of a synthetic resin, and a metallic sole plate bonded to the lower surface of the head body. The sole plate has on its surface to be bonded to the head body various members formed integrally therewith which include a hosel on the heel side, weights on the toe side and rear side, and a beam connecting the weights and the hosel.

8 Claims, 4 Drawing Sheets

WOOD TYPE GOLF CLUB HEAD

BACKGROUND OF THE INVENTION

This invention relates to a wood type golf club head, and more particularly to a wood type golf club head in which the bonding strength of a head body, consisting mainly of a synthetic resin, to a metallic sole plate is improved.

A wood type golf club head consisting mainly of a synthetic resin is composed of a head body of a synthetic resin, and a metallic sole plate. This sole plate is generally formed in the shape of a plate of around 2.0–3.5 mm in thickness, and is fixed to the head body unitarily with screws and/or a bonding agent. However, the bonding strength of these two parts is not always high. In some cases, these parts separate partially or the sole plate is deformed due to the shocks which these parts receive from a ball repeatedly being driven with the club head.

When such separation occurs in the bonded portions of the head body and sole plate, or when deformation occurs in the sole plate, a loss of kinetic energy of the club head occurs when a ball is driven therewith, and the kinetic energy is not effectively transmitted to the ball. Consequently, the flying distance of a driven ball decreases, and the direction thereof becomes inaccurate.

It is said that, in order to drive a ball in a desired direction accurately, widening a sweet area on the ball hitting surface of a club head is advantageous, and the widening of the sweet area is closely connected to the distribution of weight in the club head. However, in a conventional wood type golf club head, properly distributing and regulating the weight of each part thereof is difficult, so that the widening of the sweet area cannot be simply carried out.

SUMMARY OF THE INVENTION

An object of the present invention is to provide a wood type golf club head capable of improving the durability thereof and effectively transmitting the kinetic energy thereof to a ball when the ball is driven therewith, by improving the bonding strength of a head body consisting mainly of a synthetic resin to a metallic sole plate.

Another object of the present invention is to provide a wood type golf club head capable of easily carrying out the distribution and regulation of the weight with respect to the interior thereof, and easily widening a sweet area.

Still another object of the present invention is to provide a wood type golf club head capable of easily lofting a driven ball by lowering the center of gravity of the club head.

The wood type golf club head according to the present invention which achieves these objects comprises a head body composed mainly of a synthetic resin, and a metallic sole plate fixed to the lower surface of the head body. The sole plate has on its surface to be bonded to the head body a hosel on the heel side, weights on the toe side and rear side, and a beam connecting these weights and hosel, and those sole plate, hosel, weights and beam are formed integrally into a frame member.

Since the sole plate thus has on its surface to be bonded to the head body a hosel, weights and a beam all of which are integrally formed, a plurality of recessed and projecting portions are formed on the side of the mentioned surface of the sole plate, whereby the area of the surface to be bonded to the head body is increased. Owing to the increase of the area of this surface to be bonded, the bonding strength of this surface with respect to the head body is markedly improved. Moreover, owing to the formation of these recessed and projecting portions, the rigidity and impact-resisting strength of the sole plate are improved. Therefore, the wood type golf club head rarely separates at the bonded surfaces thereof on receiving shocks from a ball repeatedly being driven therewith, and the kinetic energy of the club head generated when a ball is driven therewith can be transmitted effectively to the ball.

Since the weights are provided at the toe side and rear side, the center of gravity can be transferred to the toe side and rear side of the head body, so that the sweet area on the ball hitting surface of the club head can be widened.

Since the widening of the sweet area and the regulating of the position of center of gravity can be done by merely adjusting the positions of the two weights, position regulating operations become easier.

DETAILED DESCRIPTION OF THE PREFERRED EMBODIMENTS

Figure 1:
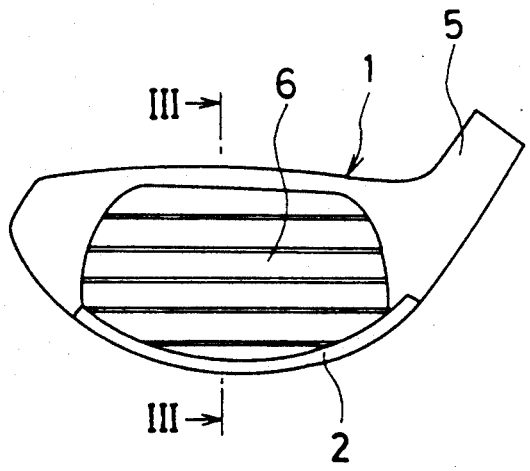
FIG. 1 is a front elevation of an embodiment of a wood type golf club head according to the present invention.
Figure 2:
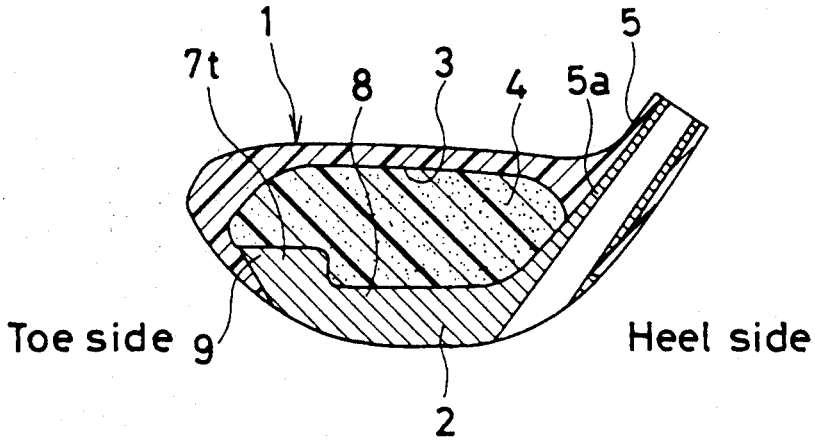
FIG. 2 is a sectional view of the same wood type golf club head, taken along a plane parallel to a ball hitting surface thereof and including the axis of a hosel thereof.
Figure 3:
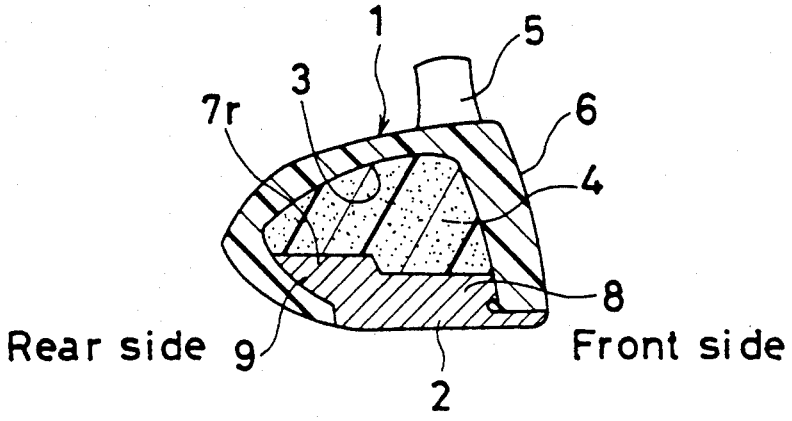
FIG. 3 is a sectional view taken along the line III—III with arrows in FIG. 1.

In the embodiment shown in FIGS. 1–3, reference numeral 1 denotes a head body formed out of a fiber-reinforced resin, and 2 a metallic sole plate fixed unitarily to the lower surface of the head body 1 with a bonding agent. The head body 1 has a ball hitting surface 6 at the front side thereof, and a club shaft-fixing hosel 5 at the heel side thereof. The head body 1 is provided in the interior thereof with a hollow space 3, in which a core member 4 consisting of a foamed material is packed.

Figure 4:
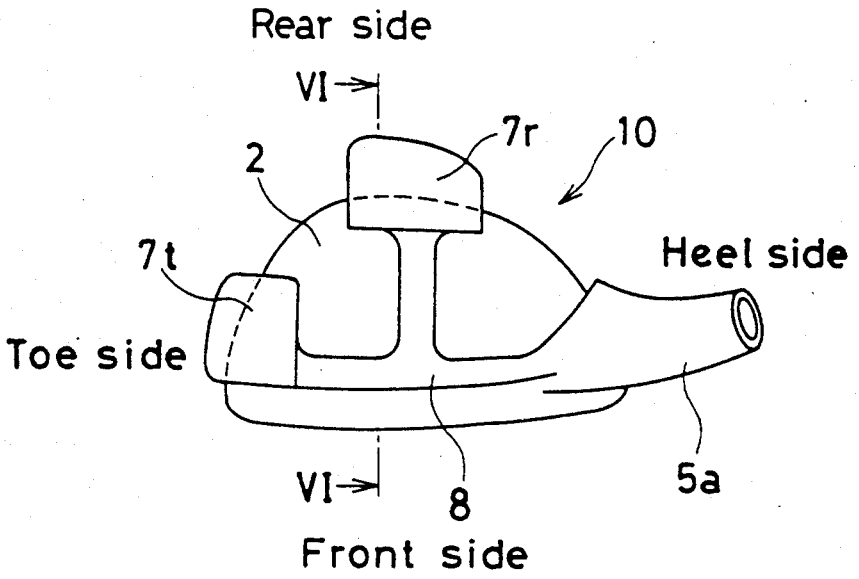
FIG. 4 is a plan view of a frame formed integrally with a sole plate.
Figure 5:
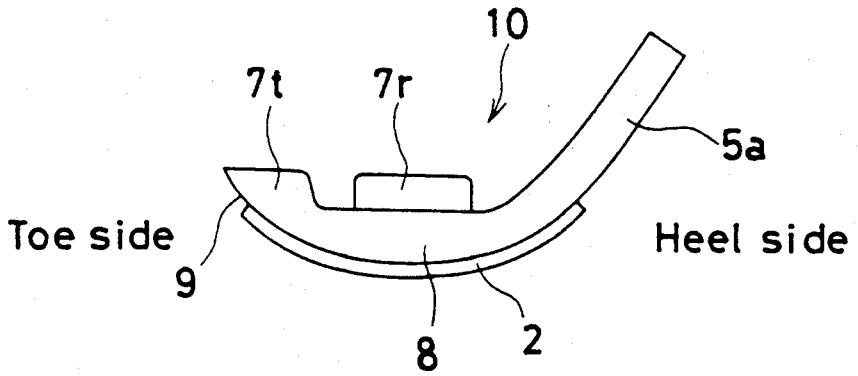
FIG. 5 is a front elevation of the frame of FIG. 4.
Figure 6:
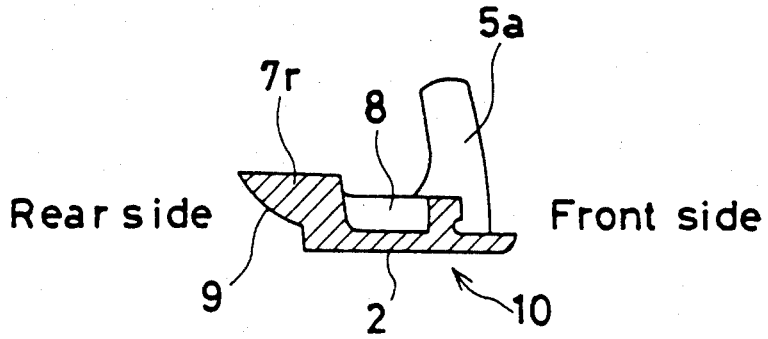
FIG. 6 is a sectional view taken along the line VI—VI with arrows in FIG. 4.

As shown in FIGS. 4–6, the sole plate 2 has a hosel 5*a* formed integrally therewith at the heel side of the surface thereof to be bonded to the head body 1, and weights 7*t*, 7*r* formed integrally with the sole plate 2 at the toe side and rear side respectively of the same surface. On the side of this surface to be bonded to the sole plate 2, a T-shaped beam 8 is formed integrally therewith, and the three end portions of this T-shaped beam are joined to the hosel 5*a* and weights 7*t*, 7*r* so as to generally form a frame 10. These two weights 7*t*, 7*r* project a part of each thereof from the outer circumference of the sole plate 2 so as to form overhanging portions 9.

This frame 10 is preferably produced by casting the hosel 5*a*, weights 7*t*, 7*r* and beam 8 integrally with the sole plate 2, and it is preferable to use a lost wax process as a casting method for this purpose. The frame 10 may also be produced by combining the hosel 5*a*, weights 7*t*, 7*r* and beam 8, which are molded independently of the sole plate 2, with the sole plate 2 by welding the former to the latter. Light metals, such as aluminum, titanium and magnesium and alloys of such light metals can be used preferably as metallic materials for producing this frame 10.

Since the frame 10 thus formed is provided on the side of its surface to be bonded to the sole plate 2 with projecting parts, such as the weights 7*t*, 7*r*, hosel 5*a* and beam 8, the area of the surface to be bonded and the rigidity of the sole plate 2 increase. Accordingly, the bonding strength of the sole plate 2 with respect to the head body 1 increases, whereby the sole plate 2 is not easily deformed even if the club head hits a ball repeatedly. If the overhanging portions 9 are formed on the weights 7*t*, 7*r* so that they are engaged with the inner surfaces of the hollow space 4 when the sole plate 2 is bonded to the head body 1, the sole plate 2 and head body 1 can be bonded together more firmly. Therefore, separation rarely occurs in the bonded surfaces of the head body 1 and sole plate 2 on receiving shocks from a ball being repeatedly driven therewith, and the kinetic energy generated when a ball is driven is transmitted to the ball more effectively. This enables a longer flying distance of a ball to be expected.

In the golf club head obtained in the above-described manner, the weights 7*t*, 7*r* are provided unevenly at the toe side and rear side of the head body 1, so that the center of gravity can be transferred to the toe side and rear side, whereby the sweet area on the ball hitting surface can be widened. Moreover, the widening of the sweet area can be done simply by merely regulating the positions of the weights 7*t*, 7*r*.

Figure 7:
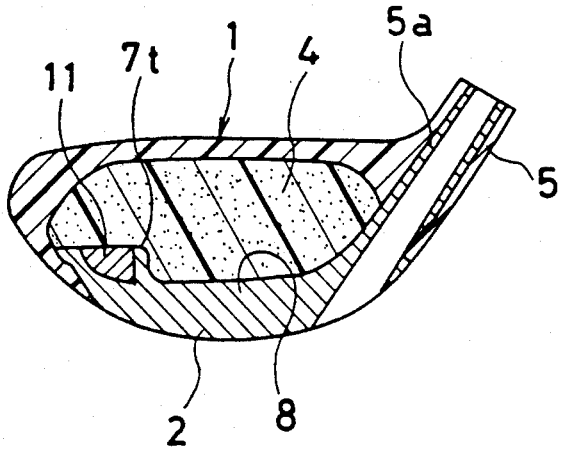
FIG. 7 is a sectional view, which corresponds to FIG. 2, of another embodiment of the wood type golf club head according to the present invention.
Figure 8:
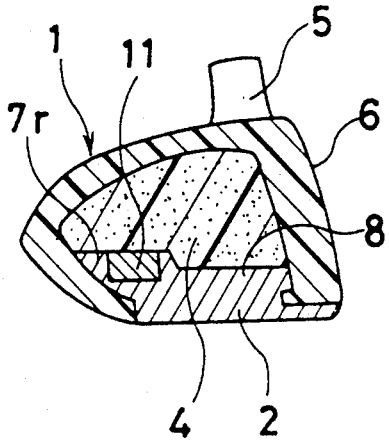
FIG. 8 is a sectional view, which corresponds to FIG. 3, of the wood type gold club head of FIG. 7.

FIGS. 7 and 8 show an embodiment in which auxiliary weights 11 are fitted in the weights 7*t*, 7*r* referred to above. Since such auxiliary weights 11 are added, the regulation of the position of the center of gravity can be done more finely, and the widening of the sweet area and the regulating of the position of the center of gravity can be done more easily. A metal of a high specific gravity, such as brass, lead, tungsten and zinc, or a synthetic resin in which these metals of high specific gravities are mixed can be used as a material for such auxiliary weights 11.

Figure 9:
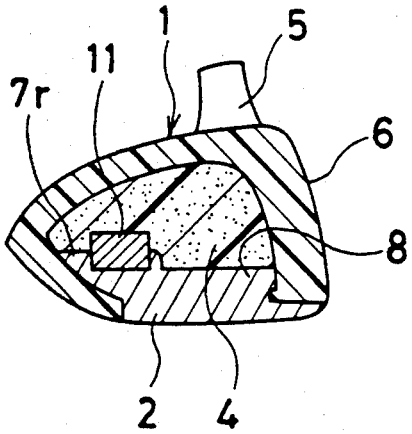
FIGS. 9 and 10 are sectional views, which correspond to FIG. 3, of some other embodiments of the wood type golf club head.
Figure 10:
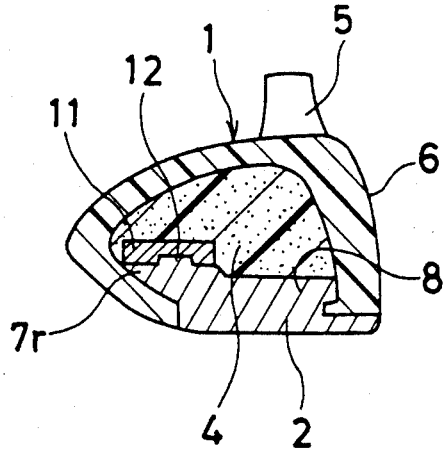

A method of fixing such auxiliary weights 11 may consist of not only a method of burying the whole of the weights 11 in the weights 7*t*, 7*r* as in the embodiment of FIGS. 7 and 8 but also a method of burying the weights 11 in the weights 7*t*, 7*r* so that a part of each of the weights 11 project from the surfaces of the weights 7*t*, 7*r* as shown in FIG. 9 or a method of forming projections 12 on the surfaces of the weights 7*t*, 7*r* and fitting the weights 11 over the projections 12 as shown in FIG. 10.

Figure 11:
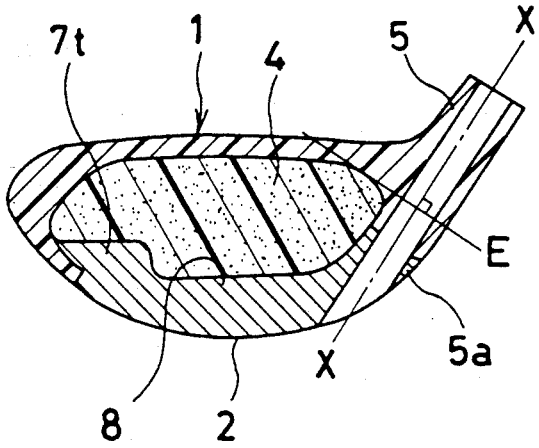
FIGS. 11 and 12 are sectional views, which correspond to FIG. 2, of still some other embodiments of the wood type golf club head.
Figure 12:
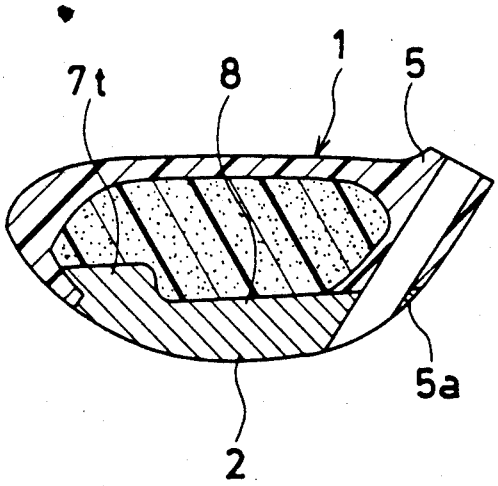

The regulation of the weight and the position of the center of gravity can also be carried out by regulating the length of the hosel 5*a*. FIG. 11 shows an embodiment in which the length of a hosel 5*a* measured from a sole plate 2 is set smaller than that of hosel 5, which is formed integrally with a head body, measured from the sole plate 2. If the position of the center of gravity of the head body 1 is regulated by adjusting the length of the hosel 5*a* in this manner, it can be lowered and transferred to the toe side, whereby it becomes possible to loft a ball more easily. When the hosel 5*a* is thus shortened, it is desirable that the upper end thereof be set lower than a plane E extending at right angles to the axis X—X of a club shaft and contacting the upper end of the core member 4. (See FIG. 11.) If the length of the hosel 5*a* is thus reduced, the strength of the head body 1 against an impact of from a ball thereupon can be improved. It is desirable that the lower limit of the length of the hosel 5*a* be set so that the upper end of the hosel is not lower than the upper surface of the beam 8 as shown in FIG. 12.

What is claimed is:

1. A wood type golf club head comprising a head body molded primarily of a synthetic resin and having a top and bottom side, a front and a rear side and a toe and a heel side, said head body having an interior hollow space having inner surfaces in which a core member is packed and a metallic sole plate having a side bonded to the bottom side of said head body, said sole plate having an outer circumference and on said side to be bonded to said head body, a hosel portion adapted to cooperate with the heel side of said head body, and weights adapted to cooperate with both the toe side and the rear side of the head body, said hosel portion and weights being integrally connected together by a beam to form a frame member, wherein said weights have overhanging portions that project beyond the outer circumference of said sole plate and that are bonded to an inner surface of said hollow space in the interior of said head body when said plate is bonded to said head body.

2. The wood type golf club head of claim 1, wherein said frame member and sole plate are integrally cast as one piece.

3. The wood type golf club of claim 1, wherein said frame member is welded to said sole plate.

4. The wood type golf club of claim 1, wherein said beam of the frame member is formed in the shape of the letter "T" having three ends, the three ends of the T-shaped beam being connected to said hosel portion and said two weights.

5. The wood type golf club head of claim 1, wherein said sole plate and frame member are formed out of a metal selected from the group consisting of aluminum, titanium, magnesium and alloys of said metals.

6. The wood type golf club of claim 1, wherein said weights have at least one auxiliary weight fixed thereto.

7. The wood type golf club of claim 6, wherein said auxiliary weight is formed out of a metal selected from the group consisting of brass, lead, tungsten and zinc or a synthetic resin in which at least one of said metals is mixed.

8. The wood type golf club of claim 1, wherein said head body has a hosel portion formed integral therewith on the heel side of the head body adapted to cooperate with the hosel portion of the frame member to form a hosel for the club head when said sole plate is bonded to said head body, each hosel portion having an upper end, the distance from said sole plate to the upper end of said hosel portion formed integral with said frame member being smaller than the distance from said sole plate to the upper end of said hosel portion formed integral with said head body.

* * * * *